US008492690B1

(12) United States Patent
Watkins

(10) Patent No.: US 8,492,690 B1
(45) Date of Patent: Jul. 23, 2013

(54) MICROWAVE SUSCEPTOR SYSTEM

(76) Inventor: Jeffrey T. Watkins, Princeton, MN (US)

( * ) Notice: Subject to any disclaimer, the term of this patent is extended or adjusted under 35 U.S.C. 154(b) by 378 days.

(21) Appl. No.: 12/822,221

(22) Filed: Jun. 24, 2010

(51) Int. Cl.
*H05B 6/64* (2006.01)

(52) U.S. Cl.
USPC ..... 219/730; 219/678; 219/762

(58) Field of Classification Search
None
See application file for complete search history.

(56) References Cited

U.S. PATENT DOCUMENTS

| | | | | |
|---|---|---|---|---|
| 4,190,757 | A | 2/1980 | Turpin et al. | |
| 4,626,641 | A | 12/1986 | Brown | |
| 4,705,929 | A | 11/1987 | Atkinson | |
| 4,745,249 | A | 5/1988 | Daniels | |
| 4,825,025 | A | 4/1989 | Seiferth | |
| 5,071,062 | A | 12/1991 | Bradley | |
| 5,153,402 | A * | 10/1992 | Quick et al. | 219/730 |
| 5,223,685 | A | 6/1993 | Derienzo, Jr. | |
| 5,247,149 | A | 9/1993 | Peleg | |
| 5,260,070 | A | 11/1993 | Peleg | |
| 5,688,427 | A | 11/1997 | Gallo, Jr. | |
| 5,725,075 | A | 3/1998 | Chou | |
| 6,137,099 | A | 10/2000 | Hamblin | |
| 6,359,272 | B1 * | 3/2002 | Sadek et al. | 219/732 |
| 6,627,862 | B1 | 9/2003 | Pederson | |
| 2003/0111463 | A1 * | 6/2003 | Lai | 219/728 |
| 2008/0017635 | A1 | 1/2008 | Watkins | |

* cited by examiner

*Primary Examiner* — Johannes P Mondt
(74) *Attorney, Agent, or Firm* — Neustel Law Offices

(57) ABSTRACT

A microwave susceptor system for cooking food in a microwave. The microwave susceptor system generally includes a platform having a support layer and a susceptor layer, sidewalls foldably connected to a first and second side of the platform and adapted to extend upwardly therefrom, and end walls foldably connected to a third and fourth side of the platform and adapted to extend upwardly therefrom. Each of the sidewalls and end walls have a support layer and a susceptor layer. Extending from each sidewall opposite the platform is a support leg. The support leg is foldably connected to the sidewall and extends downwardly from the sidewall below the platform to elevate the platform above the microwave cooking surface. The support legs are retained in position by outwardly extending flaps that connect to an adjacent end wall via a slot within the end wall.

18 Claims, 5 Drawing Sheets

MICROWAVE SUSCEPTOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a microwave platform and more specifically it relates to a microwave susceptor system for efficiently cooking food in a microwave.

2. Description of the Related Art

Any discussion of the related art throughout the specification should in no way be considered as an admission that such related art is widely known or fauns part of common general knowledge in the field.

Microwave platforms have been in use for years. Typically, microwaveable platforms are utilized by positioning a desired food item (i.e. sandwich, pizza, etc.) on top of the microwaveable platform and then cooking the food item in the microwave. The microwaveable platforms generally have a metallic or other heating material attached to an upper side of the platform which radiates heat toward the food item.

Prior microwave platforms generally have two forms. The first is a single layer susceptor tray without elevation features. Not elevating the tray and food item can decrease the performance of the susceptor tray by not allowing the tray to gather a maximum amount of heat to be transferred to the food item. Another prior form includes a tray with elevating feet that "pop out" when the tray is folded. This type of mechanism allows the food item and susceptor tray to be elevated but creates holes within the susceptor tray bottom thus creating leaking points for the melting ingredients. Because of the inherent problems with the related art, there is a need for a new and improved microwave susceptor system for cooking food in a microwave.

BRIEF SUMMARY OF THE INVENTION

A system for cooking food in a microwave. The invention generally relates to a microwave platform which includes a platform having a support layer and a susceptor layer, sidewalls foldably connected to a first and second side of the platform and adapted to extend upwardly therefrom, and end walls foldably connected to a third and fourth side of the platform and adapted to extend upwardly therefrom. Each of the sidewalls and end walls have a support layer and a susceptor layer. Extending from each sidewall opposite the platform is a support leg. The support leg is foldably connected to the sidewall and extends downwardly from the sidewall below the platform to elevate the platform above the microwave cooking surface. The support legs are retained in position by outwardly extending flaps that connect to an adjacent end wall via a slot within the end wall.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
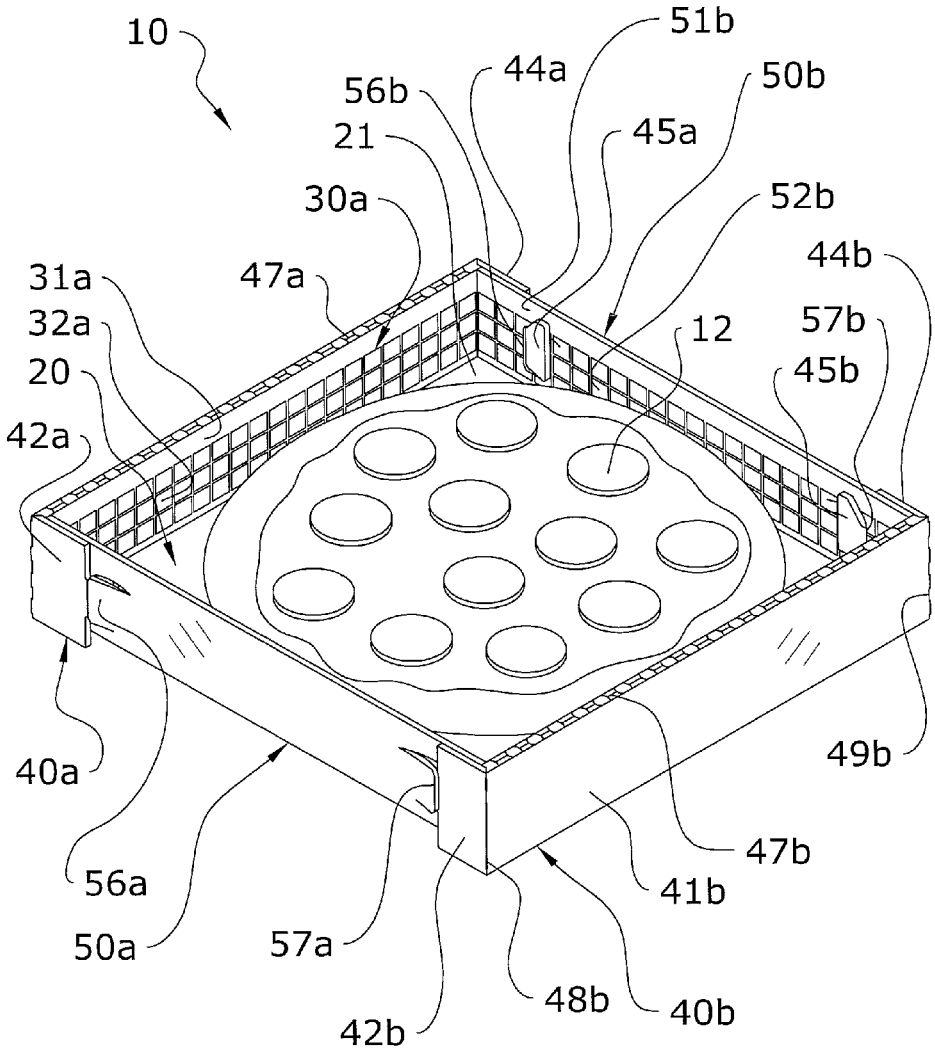
FIG. 1 is an upper perspective view of the present invention with a food item.

Turning now descriptively to the drawings, in which similar reference characters denote similar elements throughout the several views, FIGS. 1 through 5 illustrate an integral one-piece microwave susceptor system 10, which comprises a platform 20 having a support layer 21 and a susceptor layer 22*a*, 22*b*, sidewalls 30*a*, 30*b* foldably connected to a first and second side 24, 25 of the platform 20 and adapted to extend upwardly therefrom, and end walls 50*a*, 50*b* foldably connected to a third and fourth side 26, 27 of the platform 20 and adapted to extend upwardly therefrom. Each of the sidewalls 30*a*, 30*b* and end walls 50*a*, 50*b* have a support layer 31*a*, 31*b*, 51*a*, 51*b* and a susceptor layer 32*a*, 32*b*, 52*a*, 52*b*.

Extending from each sidewall 30*a*, 30*b* opposite the platform 20 is a support leg 40*a*, 40*b*. The support leg 40*a*, 40*b* is foldably connected to the sidewall 30*a*, 30*b* and extends downwardly from the sidewall 30*a*, 30*b* below the platform 20 to elevate the platform 20 above the microwave cooking surface. The support legs 40*a*, 40*b* are retained in position by outwardly extending flaps 42*a*, 42*b*, 44*a*, 44*b* that connect to an adjacent end wall 50*a*, 50*b* via a slot 56*a*, 56*b*, 57*a*, 57*b* within the end wall 50*a*, 50*b*. By not having defined openings between the platform 20 and the sidewalls 30*a*, 30*b* and end walls 50*a*, 50*b*, the present invention retains substantially leak-proof properties, wherein leaking juices from the food item 12 are generally not able to soak through the fold lines 34*a*, 34*b*, 54*a*, 54*b* surrounding the platform 20, wherein the fold lines 34*a*, 34*b*, 54*a*, 54*b* are generally comprised of cut scores.

B. Platform

The platform 20 is generally comprised a size large enough to place various size food item 12*s* thereon, yet fit within a conventional microwave oven. In the preferred embodiment, the platform 20 is comprised of a square shape; however it is appreciated that other shapes may be appreciated in alternate embodiments of the present invention. The platform 20 generally has a first, second, third, and fourth sides 24-27 to completely surround a perimeter of the platform 20. The sidewalls 30*a*, 30*b* and end walls 50*a*, 50*b* extend upwardly from the sides 24-27 of the platform 20 thus completely surrounding the food item 12 placed upon the platform 20.

The platform 20 includes a susceptor layer 22*a*, 22*b* and a support layer 21, wherein the susceptor layer 22*a*, 22*b* is stacked upon the support layer 21 and forms the engaging surface in which the food item 12 is placed upon. The support layer 21 may be comprised of various materials, such as but not limited to paperboard. The susceptor layer 22*a*, 22*b* is generally comprised of a susceptor material to absorb electromagnetic energy and convert the electromagnetic energy to heat to be transferred to the food item 12.

The support layer 21 generally comprises the exterior surface of the platform 20 and is used to both absorb moisture or liquid released from the food item 12 and to provide support to the susceptor layer 22*a*, 22*b*. The susceptor layer 22*a*, 22*b* is generally comprised of a thinner and less rigid structure than the support layer 21. The outer corners of the platform 20, or areas in which the food item 12 does not normally contact, generally do not include the susceptor layer 22*a*, 22*b* and are solely comprised of the support layer 21 as illustrated in FIGS. 1 and 2.

Figure 2:
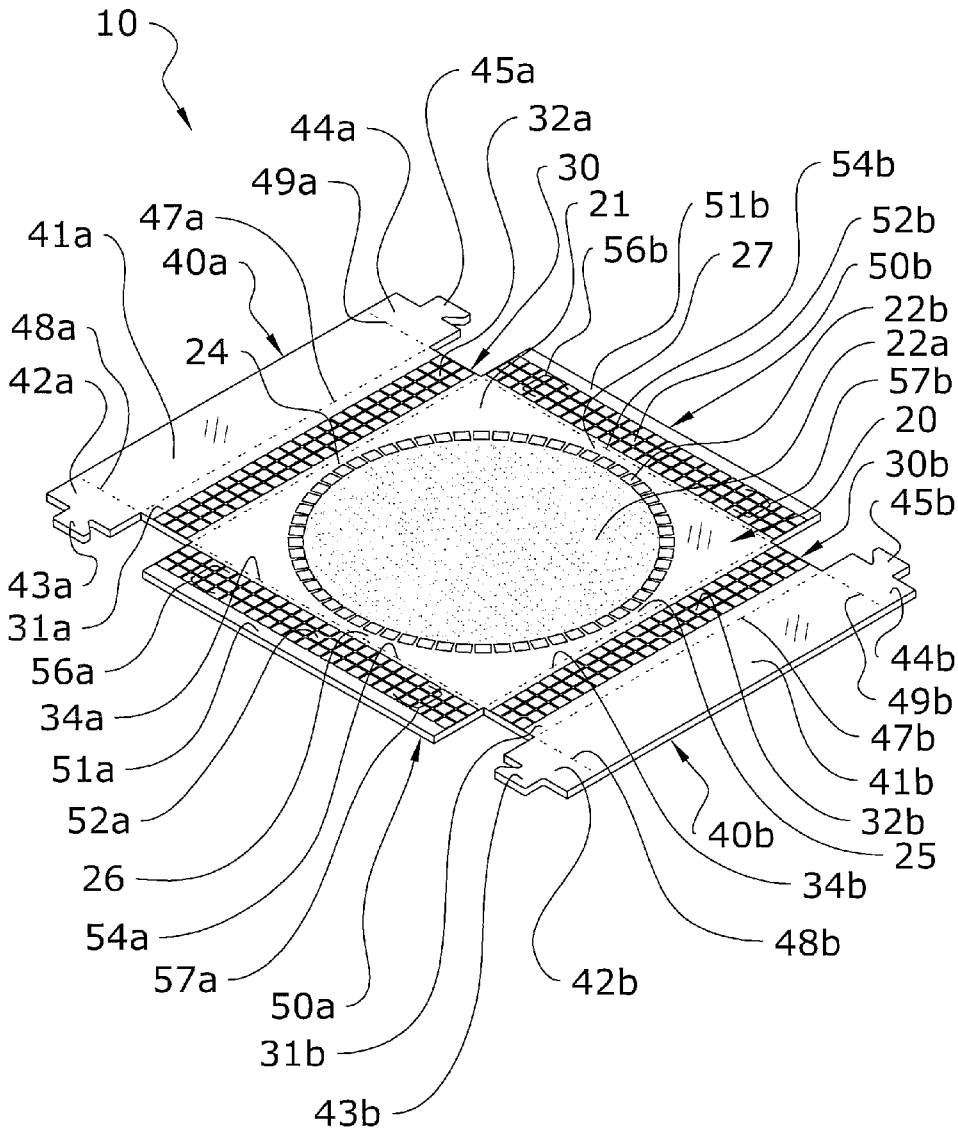
FIG. 2 is an upper perspective view of the present invention in an unfolded position.
Figure 3:
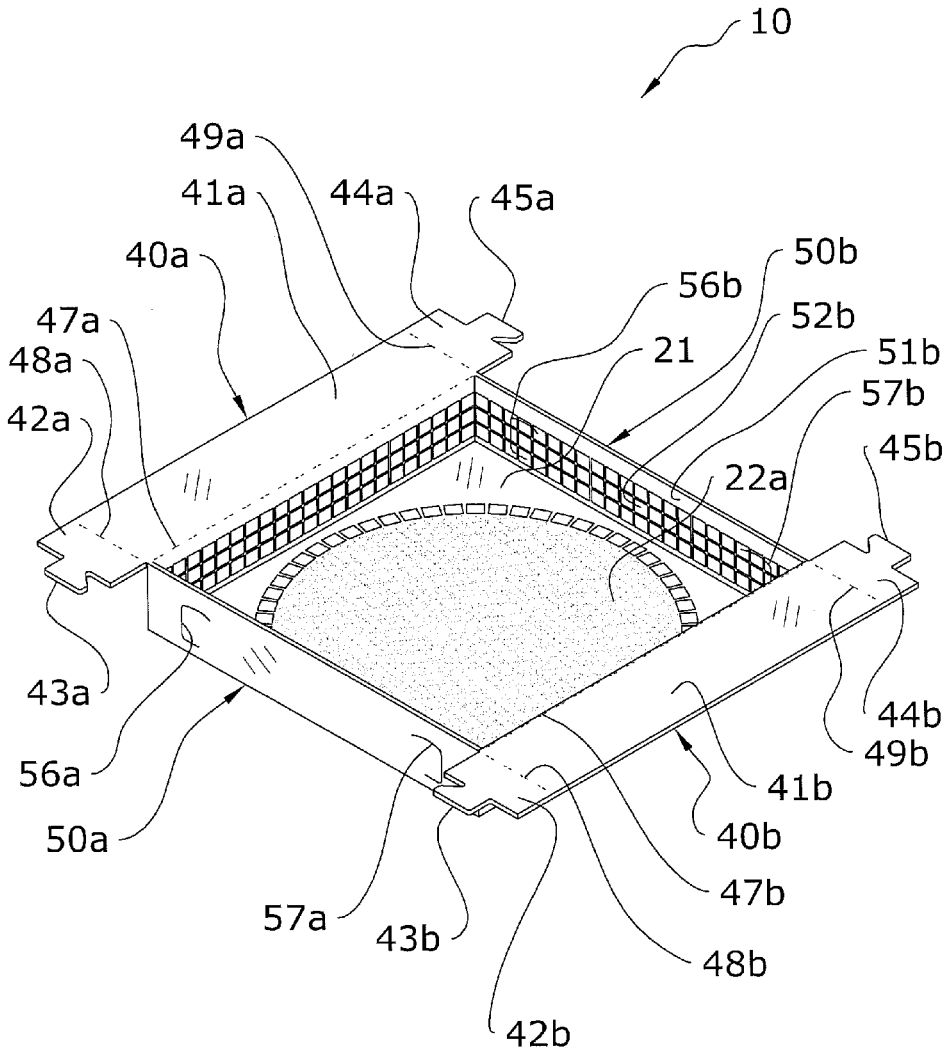
FIG. 3 is an upper perspective view of the present invention with the sidewalls and end walls folded upwards.

The susceptor layer 22*b* may include a demetallizing pattern in areas that the heat collection is desired to be less in order to prevent burning or over cooking of the food item 12, such as shown by the pattern of the outside susceptor layer portion 22*b* as illustrated in FIG. 2. In the preferred embodiment, the demetallizing pattern of the outside susceptor layer portion 22*b* is illustrated along the perimeter of the inside susceptor layer portion 22*a* wherein the food item 12 may not need as much cooking in this area.

It is appreciated that the smaller the squares or lesser metallic area of the outside susceptor layer portion 22*b*, the less heat will be collected and produced. The squares, as illustrated with the outside susceptor layer portion 22*b*, include the metallic material deemed susceptor material, and the surrounding grid around the squares does not.

In alternate embodiments, the squares of the outside susceptor layer portion 22*b* may be smaller and grid more pronounced and thus a greater amount of area is demetalized and a lesser amount of heat is collected and transferred to the food item 12. The inside susceptor layer portion 22*a* inside of the outside susceptor layer portion 22*b* is generally comprised of a solid structure to embody a large surface area and provide for a maximum cooking temperature to the food item 12, such as illustrated through the solid circular shape.

C. Sidewalls

The sidewalls 30*a*, 30*b* are foldably connected to the first and second sides 24, 25 of the platform 20, generally through a fold line 34*a*, 34*b* comprised of a cut score as illustrated in FIG. 2. The sidewalls 30*a*, 30*b* generally are comprised of an elongated rectangular shape to follow the entire length of the first and second sides 24, 25 of the platform 20 and extend upwardly therefrom when folded to a vertical orientation, perpendicular with the platform 20.

Each of the sidewalls 30*a*, 30*b* generally include a susceptor layer 32*a*, 32*b* and a support layer 31*a*, 31*b*, wherein the susceptor layer 32*a*, 32*b* is stacked upon the support layer 31*a*, 31*b* and faces the food item 12 placed upon the platform 20. The support layer 31*a*, 31*b* may be comprised of various materials, such as but not limited to paperboard. The susceptor layer 32*a*, 32*b* is generally comprised of a susceptor material to absorb electromagnetic energy and convert the electromagnetic energy to heat to be transferred to the food item 12. The susceptor layer 32*a*, 32*b* may include a similar grid-shaped demetallizing pattern as shown with the outside susceptor layer portion 22*b* of the platform 20. However, various patterns and shapes of the susceptor layer 32*a*, 32*b* may be appreciated.

D. Support Legs

The support legs 40*a*, 40*b* are foldably connected to the outer longitudinal edges of the sidewalls 30*a*, 30*b* opposite the platform 20, generally through a fold line 47*a*, 47*b* comprised of a cut score as illustrated in FIG. 2. The support legs 40*a*, 40*b* generally are comprised of an elongated rectangular shape to follow at least the entire length of the sidewalls 30*a*, 30*b* and extend downwardly from an outer peripheral edge of the sidewalls 30*a*, 30*b* and below the platform 20 to elevate the platform 20. Thus, the width of the support legs 40*a*, 40*b* is sufficiently greater than the width of the sidewalls 30*a*, 30*b* so that the support legs 40*a*, 40*b* may extend from an upper end of the sidewalls 30*a*, 30*b* (when folded vertically) to a point below the platform 20 to elevate the platform 20.

The support legs 40*a*, 40*b* are not in visible communication with the food item 12 upon the platform 20 and thus generally do not need a susceptor layer and are solely comprised of a paperboard material. The support legs 40*a*, 40*b* generally include an elongated portion 41*a*, 41*b* to extend the entire length of the associated sidewall 30*a*, 30*b* and a pivotal flap 42*a*, 42*b*, 44*a*, 44*b* foldably connected, via a fold line 48*a*, 48*b*, 49*a*, 49*b* generally comprised of a cut score, to each opposing longitudinal end of the elongated portion 41*a*, 41*b* for connecting to an adjacent end of the end wall 50*a*, 50*b*.

Each flap 42*a*, 42*b*, 44*a*, 44*b* extends outwardly from a respective end of the elongated portion 41*a*, 41*b* so that the flap 42*a*, 42*b*, 44*a*, 44*b* may fold perpendicular from the elongated portion 41*a*, 41*b* toward an opposing sidewall 30*a*, 30*b* and against the exterior surface of the adjacent end wall 50*a*, 50*b*. Each flap 42*a*, 42*b*, 44*a*, 44*b* generally includes a tab 43*a*, 43*b*, 45*a*, 45*b* extending outwardly therefrom having a curved notch to easily receive and be retained within the respective slot 56*a*, 56*b*, 57*a*, 57*b*. The tab 43*a*, 43*b*, 45*a*, 45*b* is inserted within the slot 56*a*, 56*b*, 57*a*, 57*b* to extend through the end wall 50*a*, 50*b* and extend along an interior surface of the respective end wall 50*a*, 50*b* thus sufficiently retaining the tab 43*a*, 43*b*, 45*a*, 45*b* within the slot 56*a*, 56*b*, 57*a*, 57*b* and the support leg 40*a*, 40*b* in a vertical orientation.

E. End Walls

The end walls 50*a*, 50*b* are foldably connected to the third and fourth sides 26, 27 of the platform 20, generally through a fold line 54*a*, 54*b* comprised of a cut score as illustrated in FIG. 2. The end walls 50*a*, 50*b* generally are comprised of an elongated rectangular shape to follow the entire length of the third and fourth sides 26, 27 of the platform 20 and extend upwardly therefrom when folded to a vertical orientation, perpendicular with the platform 20.

Each of the end walls 50*a*, 50*b* generally include a susceptor layer 52*a*, 52*b* and a support layer 51*a*, 51*b*, wherein the susceptor layer 52*a*, 52*b* is stacked upon the support layer 51*a*, 51*b* and faces the food item 12 placed upon the platform 20. The support layer 51*a*, 51*b* may be comprised of various materials, such as but not limited to paperboard. The susceptor layer 52*a*, 52*b* is generally comprised of a susceptor material to absorb electromagnetic energy and convert the electromagnetic energy to heat to be transferred to the food item 12. The susceptor layer 52*a*, 52*b* may include a similar grid-shaped demetallizing pattern as shown with the outside susceptor layer portion 22*b* of the platform 20. However, various patterns and shapes of the susceptor layer 52*a*, 52*b* may be appreciated.

Figure 4:
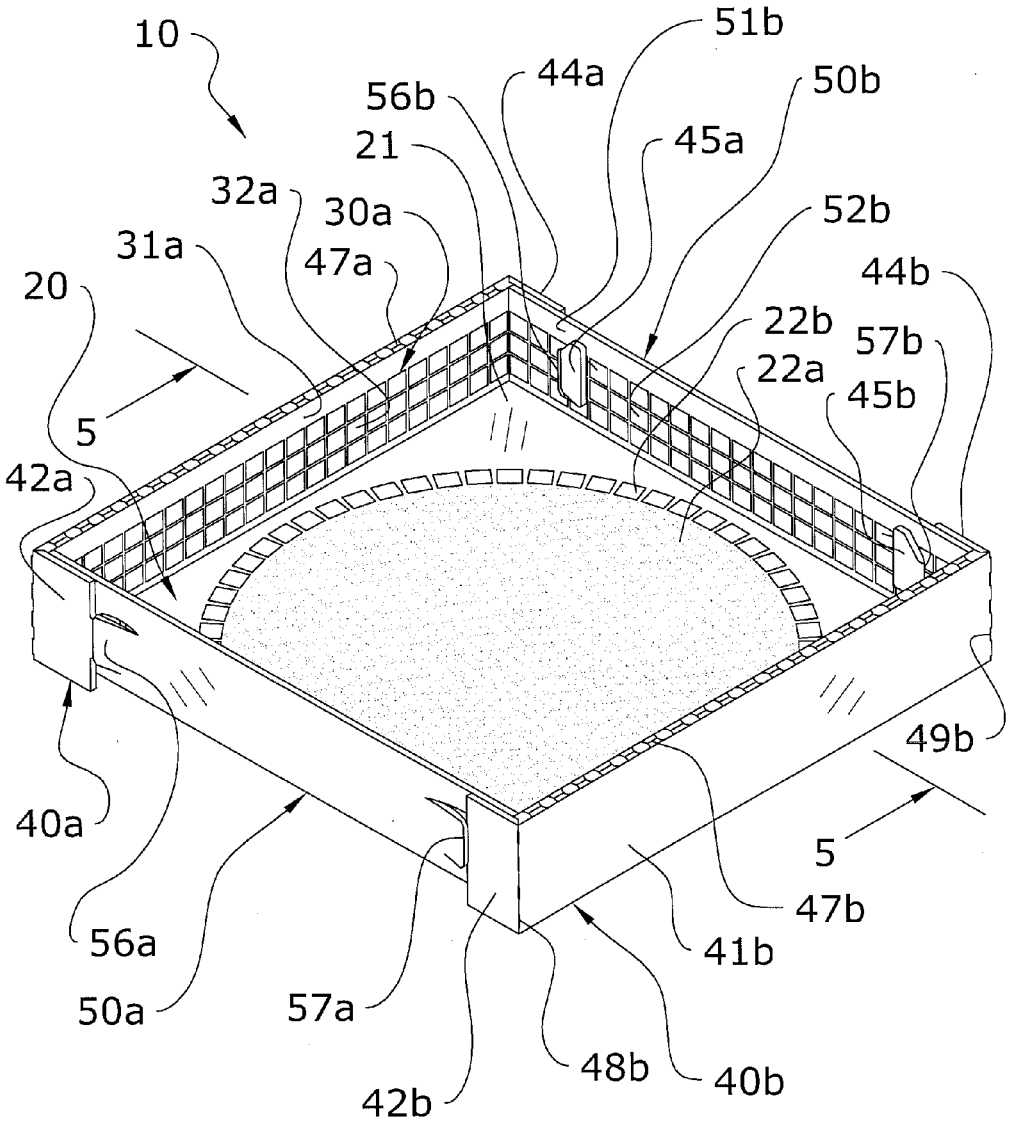
FIG. 4 is an upper perspective view of the present invention with the sidewalls and end walls folded upwards and the support legs folded downwards and connected to the end walls.
Figure 5:
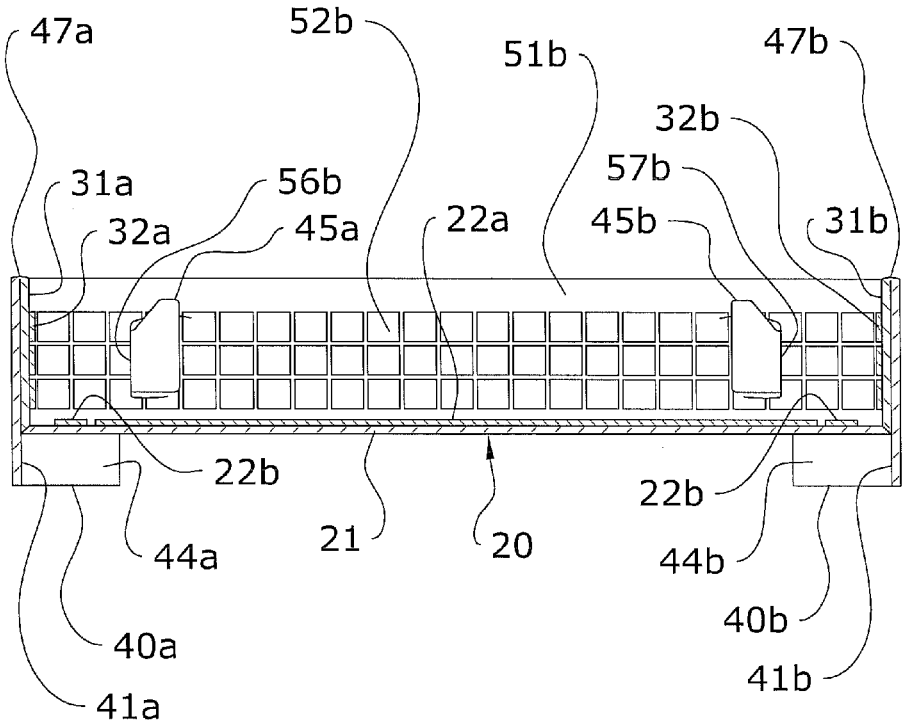
FIG. 5 is a sectional view taken along lines 5-5 of FIG. 4.

Each of the end walls 50*a*, 50*b* also generally includes a first and second slot 46*a*, 46*b*, 57*a*, 57*b* extending through the end wall 50*a*, 50*b* and generally through both the support layer 51*a*, 51*b* and the susceptor layer 52*a*, 52*b* of the end wall 50*a*, 50*b*, wherein the first slot 46*a*, 46*b* is adjacent a first end of the end wall 50*a*, 50*b* for receiving a respective tab 43*a*, 45*a* of the first sidewall 30*a* and the second slot 47*a*, 47*b* is adjacent a second end of the end wall 50*a*, 50*b* for receiving a respective tab 43*b*, 45*b* of the second sidewall 30*b*. The slots 46*a*, 46*b*, 57*a*, 57*b* generally curve inwardly to easily receive the tabs 43*a*, 43*b*, 45*a*, 45*b* and ensure the tabs 43*a*, 43*b*, 45*a*, 45*b* are retained thereon so that the support legs 40*a*, 40*b* remain in the vertical orientation such as illustrated in FIGS. 4 and 5.

F. Assembly and Operation of Preferred Embodiment

During assembly, the present invention is laid on a flat surface with the susceptor layers 22*a*, 22*b*, 32*a*, 32*b*, 52*a*, 52*b* facing upwards. Each of the sidewalls 30*a*, 30*b* and end walls 50*a*, 50*b* are then folded upwardly to a vertical orientation, perpendicular with the platform 20, along the respective fold line 34*a*, 34*b*, 54*a*, 54*b*. The support legs 40*a*, 40*b* are then folded downward to a vertical orientation along the exterior surface of the respective sidewall 30*a*, 30*b* so that both the elongated portion 41*a*, 41*b* and the flaps 42*a*, 42*b*, 44*a*, 44*b* extend below the platform 20 thus elevating the platform 20.

It is appreciated that the support legs 40*a*, 40*b* may be preattached or glued to the exterior surface of the sidewalls 30*a*, 30*b* in an alternate embodiment so that the support legs 40*a*, 40*b* automatically are folded to a vertical orientation to extend below the platform 20 when folding the sidewalls 30*a*, 30*b* to the vertical orientation. The flaps 42*a*, 42*b*, 44*a*, 44*b* are folded inwardly towards a respective end wall 50*a*, 50*b* and the tabs 43*a*, 43*b*, 45*a*, 45*b* of the flaps 42*a*, 42*b*, 44*a*, 44*b* are inserted within a respective slot 56*a*, 56*b*, 57*a*, 57*b* through the respective end wall 50*a*, 50*b* to secure the support legs 40*a*, 40*b* in place relative the sidewalls 30*a*, 30*b* and the end walls 50*a*, 50*b*.

In use, the food item 12 may now be placed upon the susceptor layer 22*a*, 22*b* of the platform 20 and cooked in the microwave. The susceptor layer 22*a*, 22*b* of the platform 20 and the susceptor layers 32*a*, 32*b*, 52*a*, 52*b* of the sidewalls 30*a*, 30*b* and the end walls 50*a*, 50*b* work to absorb electromagnetic energy from the microwave oven and convert the electromagnetic energy to heat to be transferred to the food item 12.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A microwave susceptor tray configured for microwave heating a food item that is substantially leak-proof, comprising:

a platform configured to support and receive a food item, wherein said platform includes an inside susceptor layer portion;

a plurality of walls attached to a perimeter of said platform and extending upwardly from said platform, wherein said plurality of walls are adjacent to one another forming a perimeter wall along said perimeter of said platform, wherein said plurality of walls are comprised of a first sidewall, a second sidewall, a first end wall and a second end wall;

a first support leg attached to a first upper end of said first sidewall, wherein said first support leg includes a first elongated portion that extends downwardly parallel to said first sidewall and extends below said platform, wherein said first support leg includes a pair of first pivotal flaps extending perpendicularly at opposing ends of said first elongated portion, wherein said first pivotal flaps extend over respective corners of said plurality of walls adjacent said first sidewall, said first pivotal flaps being configured to seal said first adjacent corners, and wherein said pair of first pivotal flaps are attached to the first and second end wall adjacent to said first sidewall; and a second support leg attached to a second upper end of said second sidewall, wherein said second support leg includes a second elongated portion that extends downwardly parallel to said second sidewall and extends below said platform, wherein said second support leg includes a pair of second pivotal flaps extending perpendicularly at opposing ends of said second elongated portion, wherein said second pivotal flaps extend over respective corners of said plurality of walls adjacent said second sidewall, said second pivotal flaps being configured to seal said adjacent corners, and wherein said pair of second pivotal flaps are attached to the first and second end wall adjacent to said second sidewall;

wherein there are no openings between said platform and said plurality of walls and wherein said tray is substantially leak-proof preventing leakage of juices from said food item exteriorly from said tray.

2. The microwave susceptor tray of claim 1, including a pair of first tabs each extending from respective ones of the pair of first pivotal flaps and received in a respective one of a pair of slots in the first and second end wall, respectively, and a pair of second tabs each extending from respective ones of the pair of first pivotal flaps and received in a respective one of a pair of slots in the first and second end wall, respectively.

3. The microwave susceptor tray of claim 1, wherein each one of said pair of first pivotal flaps extends downwardly the same distance as the first elongated portion, and wherein each one of said pair of second pivotal flaps extends downwardly the same distance as the second elongated portion.

4. The microwave susceptor tray of claim 3, wherein each one of said pair of first pivotal flaps is shorter than said first elongated portion and wherein each one of said pair of second pivotal flaps is shorter than said second elongated portion.

5. The microwave susceptor tray of claim 1, wherein said first support leg is positioned on a first side of said platform and wherein said second support leg is positioned on a second side of said platform, wherein said second side is opposite of said first side.

6. The microwave susceptor tray of claim 5, wherein each one of said pair of first pivotal flaps extends towards said pair of second pivotal flaps, and wherein each one of said pair of second pivotal flaps extends towards said pair of first pivotal flaps.

7. The microwave susceptor tray of claim 6, wherein each of said pair of first pivotal flaps is parallel to each of said pair of second pivotal flaps.

8. The microwave susceptor tray of claim 1, wherein said platform is rectangular shaped.

9. The microwave susceptor tray of claim 1, wherein each of said plurality of walls includes an inner susceptor layer on an inside surface facing an interior portion of said microwave susceptor tray.

10. The microwave susceptor tray for heating a food item that is substantially leak-proof, comprising:

a platform configured to support a food item, wherein said platform includes a first susceptor layer;

a plurality of walls attached to a perimeter of said platform and extending upwardly from said platform, wherein said plurality of walls are adjacent to one another forming a perimeter wall along said perimeter of said platform;

a first support leg attached to a first upper end of a first sidewall, wherein said first support leg includes a first elongated portion that extends downwardly parallel to said first sidewall and extends below said platform, wherein said first support leg includes a pair of first pivotal flaps extending perpendicularly at opposing ends of said first elongated portion, wherein said first pivotal flaps extend over respective corners of said plurality of walls adjacent said first sidewall, said first pivotal flaps being configured to seal said first adjacent corners, and wherein said pair of first pivotal flaps are attached to the first and second end wall adjacent to said first sidewall; and a second support leg attached to a second upper end of a second sidewall, wherein said second support leg includes a second elongated portion that extends downwardly parallel to said second sidewall and extends below said platform, wherein said second support leg includes a pair of second pivotal flaps extending perpendicularly at opposing ends of said second elongated portion, wherein said second pivotal flaps extend over respective corners of said plurality of walls adjacent said second sidewall, said second pivotal flaps being configured to seal said adjacent corners, and wherein said pair of second pivotal flaps are attached to the first and second end wall adjacent to said second sidewall;

wherein there are no openings between said platform and said plurality of walls and wherein said tray is substantially leak-proof preventing leakage of juices from said food item exteriorly from said tray.

11. The microwave susceptor tray of claim 10, including a pair of first tabs each extending from respective ones of the pair of first pivotal flaps and received in a respective one of a pair of slots in the first and second end wall, respectively, and a pair of second tabs each extending from respective ones of the pair of first pivotal flaps and received in a respective one of a pair of slots in the first and second end wall, respectively.

12. The microwave susceptor tray of claim 10, wherein each one of said pair of first pivotal flaps extends downwardly the same distance as the first elongated portion, and wherein each one of said pair of second pivotal flaps extends downwardly the same distance as the second elongated portion.

13. The microwave susceptor tray of claim 12, wherein each one of said pair of first pivotal flaps is shorter than said first elongated portion and wherein each one of said second pair of flaps is shorter than said second elongated portion.

14. The microwave susceptor tray of claim 10, wherein said first support leg is positioned on a first side of said platform and wherein said second support leg is positioned on a second side of said platform, wherein said second side is opposite of said first side.

15. The microwave susceptor tray of claim 14, wherein each one of said pair of first pivotal flaps extends towards said pair of second pivotal flaps, wherein each one of said pair of second pivotal flaps extends towards said pair of first pivotal flaps.

16. The microwave susceptor tray of claim 15, wherein each of said pair of first pivotal flaps is parallel to each of said pair of second pivotal flaps.

17. The microwave susceptor tray of claim 10, wherein said platform is rectangular shaped.

18. The microwave susceptor tray of claim 10, wherein each of said plurality of walls includes an inner susceptor layer on an inside surface facing an interior portion of said microwave susceptor tray.

* * * * *